United States Patent [19]

Meade et al.

[11] 3,977,588

[45] Aug. 31, 1976

[54] APPARATUS FOR HANDLING FLEXIBLE WEBS

[75] Inventors: Charles B. Meade, Arlington Heights; Guy L. Pikul, Chicago; Thomas J. Carberry, Wheaton, all of Ill.

[73] Assignee: Vision Wrap Industries, Inc., Palatine, Ill.

[22] Filed: Feb. 24, 1975

[21] Appl. No.: 552,593

[52] U.S. Cl. ..... 226/168

[51] Int. Cl.[2] ..... B65H 17/24

[58] Field of Search ..... 226/109, 108, 168, 171; 26/63; 242/67.1, 56.9, 67.3

[56] References Cited

UNITED STATES PATENTS

| | | | |
|---|---|---|---|
| 2,042,010 | 5/1936 | Lewis | 26/63 |
| 2,139,164 | 12/1938 | Knowlton | 226/171 X |
| 2,204,600 | 6/1940 | Kabela | 226/108 X |
| 2,560,039 | 7/1951 | Harlow | 26/63 |
| 3,186,443 | 6/1965 | Budzyna | 26/63 X |
| 3,344,493 | 10/1967 | Telgheider | 26/63 |

*Primary Examiner*—Richard A. Schacher

*Attorney, Agent, or Firm*—McDougall, Hersh & Scott

[57] ABSTRACT

An apparatus for transporting a continuous stretchable web wherein the stretchable web is positioned in face-to-face contact with a carrier web, the overlying webs are transported through a printing machine or other apparatus and then moved to a web separator for separating the stretchable web from the carrier web. A spreader means is associated with the separator for imparting a laterally directed spreading force to the stretchable web so that the stretchable web can be collected on a take-up roll or the like.

15 Claims, 7 Drawing Figures

APPARATUS FOR HANDLING FLEXIBLE WEBS

This invention generally relates to an apparatus for transporting a continuous stretchable web. The invention is particularly concerned with the handling of films of stretchable material, for example, polyvinyl chloride films.

It is well-known that certain stretchable films can be extremely difficult to handle. When forces of any type are applied to the films, a set of greater or lesser degree is usually developed by the film. Where mechanisms are designed to engage the film, for example transporting rollers, the set in the film can vary the result which the mechanisms produce in the film. For example, the film might be thrown off a desired path of movement over transporting rollers when subjected to unanticipated forces. As is well-known, films of the type referred to can be extremely sensitive so that even small forces can disrupt an operation.

It is generally accepted that certain films are not suited for printing operations, particularly where the printing must be applied in a rather controlled fashion. As an illustration, the wrapping material for meat products is desirably printed with a particular pattern appearing on the film at precisely controlled intervals. These intervals are necessarily controlled since the film is desirably utilized in automatic packaging equipment, and if the pattern positions are not carefully controlled, the automatic packaging equipment will tend to locate the pattern in irregular positions relative to the product being packaged or container being wrapped, whichever is the case.

Although stretchable film such as polyvinyl chloride film is desirably used for packaging operations of the type referred to, the tendency of the material to stretch has made it virtually impossible to print the film. Accordingly, it has been the practice to avoid printing film of this type or to print only film which is much less susceptible to stretching. Supporting of the film on a backing or carrier film is not considered efficient since the films must then be separated in a separate operation.

It is a general object of this invention to provide an improved means for the transport of stretchable film.

It is a more specific object of this invention to provide an improved means for handling of stretchable film such as polyvinyl chloride film whereby the film can be transported through printing equipment and similar systems without any significant tendency toward stretching whereby operations on the film can be very readily controlled.

It is a still further object of this invention to provide an arrangement of the type described which includes a carrier web for the film and a separator apparatus which is particularly suitable for insuring controlled handling of stretchable film whereby the film can be efficiently collected as an integral step of a printing operation.

These and other objects of this invention will appear hereinafter and for purposes of illustration, but not of limitation, specific embodiments of the invention are shown in the accompanying drawings in which.

This invention generally comprises an apparatus for transporting a continuous web of stretchable film. The apparatus involves the use of a carrier web having associated drive means whereby the web is adapted to move continuously through the apparatus. Means are provided for delivering the web of stretchable material to the carrier web to locate the stretchable web in face-to-face contact with the carrier web. The webs are then adapted to be transported in overlying relationship through various stations of the apparatus.

A web separator is included in the apparatus for purposes of dividing the respective webs with a take-up roll for the stretchable web being included as part of the separator.

The separator also preferably includes a film spreader means. In particular, the spreader means operates to engage the stretchable web as the stretchable web is separated from the carrier web. This spreader means, in effect, directs forces laterally across the stretchable web whereby any tendency for the stretchable web to "bunch up" or to move in an irregular fashion is substantially eliminated. This arrangement in particular permits efficient take-up of the stretchable web with regularly formed rolls of the stretchable web being provided. The regularity of the rolls of the stretchable web is a highly important characteristic when it comes to use of the stretchable web in automatic packaging machinery.

Figure 1:
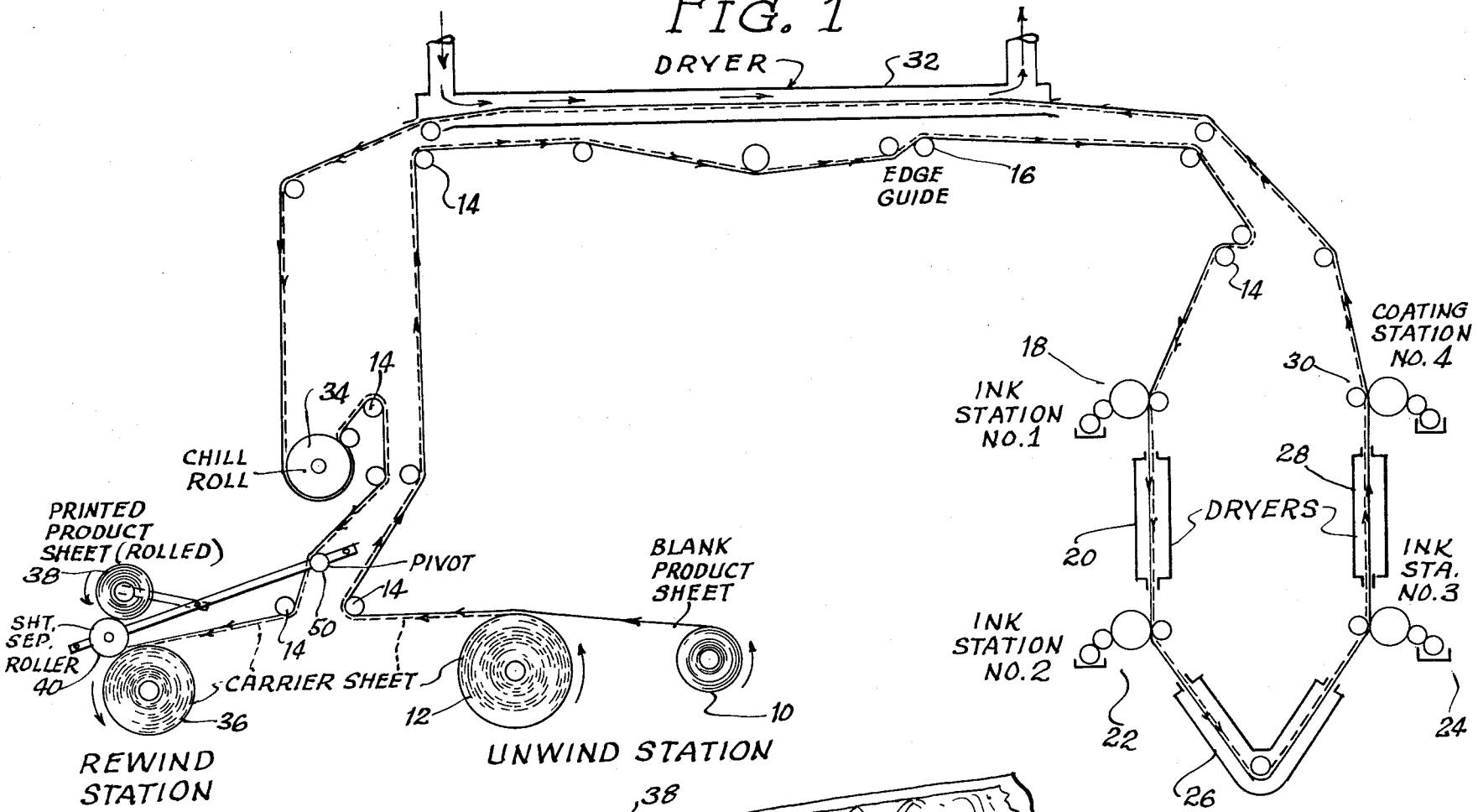
FIG. 1 is a schematic illustration of a printing apparatus which includes the improvements of this invention.
Figure 2:
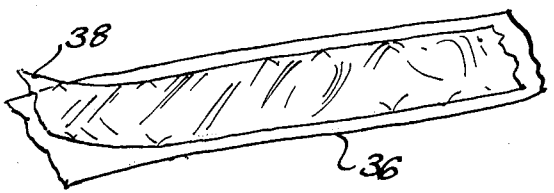
FIG. 2 is a fragmentary perspective view illustrating the web combinations utilized in the practice of the invention.

The drawings illustrate various structural features of the invention. In addition, FIG. 1 illustrates a particularly importatnt arrangement characterized by the improvements of the invention. The illustration comprises a printing operation wherein a roll 10 of a stretchable film material is made available for printing.

A second roll 12 is made up of a carrier sheet which is located in line with the stretchable web being fed from roll 10. The stretchable web moves into face-to-face contact with the carrier web so that a two-ply arrangement is provided.

The printing arrangement illustrated is not itself a part of this invention, and it will be understood that the concepts of this invention may be utilized in conjunction with other printing machines as well as for other purposes. In the printing machine illustrated, the overlying webs are directed by means of idler rollers 14 disposed at various positions along the path of movement of the webs. Drive means for moving the two-ply arrangement may also be of any conventional type.

In accordance with conventional practice, an edge guide arrangement may be included as shown at 16 for purposes of lining the stretchable web up with the printing stations to follow. A first printing station is illustrated at 18, and a dryer 20 is illustrated immediately beyond this printing station. Similarly, printing stations 22 and 24 have dryers 26 and 28, respectively.

A coating station 30 is located beyond the dryer 28, and a large dryer 32 is positioned beyond this latter station. Material moving from the dryer 32 is engaged with chill roll 34 with additional idlers 14 then serving to direct the two-ply web.

The two-ply web is directed to a separator apparatus. This apparatus consists of a take-up roll 36 for the carrier web, a take-up roll 38 for the stretchable web and a spreader roll 40.

The separator structure is shown in greater detail in FIGS. 3–7. This structure comprises a support 42 having a pair of arms 44 pivotally mounted on shaft 46. Connecting rods 48 are located at the front and rear ends of the arms 44 and intermediate the ends for holding the arms in an assembly. An idler roller 50 is supported by shaft 46 for purposes of directing the two-ply web to the idler roller 14 positioned beneath the support 42.

The arms 44 define openings receiving bearings for the ends of shaft 52 of spreader roll 40. The arms 44 also receive the ends of shaft 54 which provides pivoting support for the arms 56 and 58. The arms 56 and 58 define opposed openings for receiving the shaft 60 of a stretchable web take-up roll 62.

Figure 5:
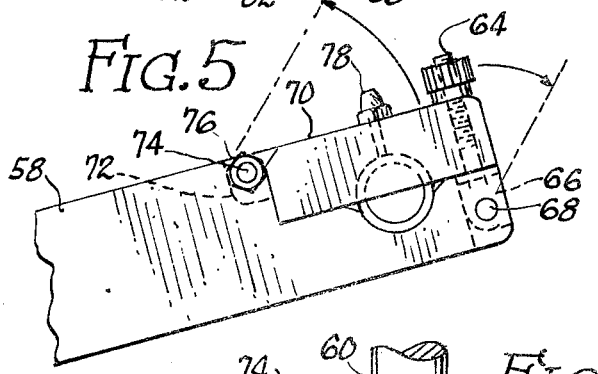
FIG. 5 is an enlarged fragmentary view illustrating a roll securing means utilized in the illustrated construction.
Figure 6:
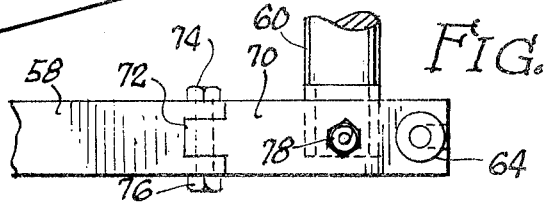
FIG. 6 is a side elevation of the securing means shown in FIG. 5.
Figure 7:
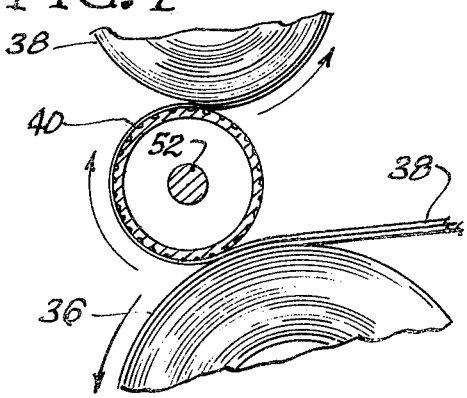
FIG. 7 is an enlarged fragmentary view illustrating certain details of a separator roll utilized in accordance with the invention.

The arm 58 is designed to permit quick removal of a take-up roll. Thus, the particular system illustrated involves printing of a stretchable web supplied from a roll 10, and when this roll is exhausted, a new supply is provided. The printed web 38 formed on the take-up roll 62 is removed at the same time, and an empty take-up roll put into place. This is accomplished by means of the arm 58 which is provided with a clamping bolt 64 which, when loosened, is adapted to pivot clockwise as shown in FIG. 5. Thus, a nut 66 is pivotally secured around the shaft 68 extending between a bifurcated end portion of the arm 58, and the bolt 64 is threaded into an opening in the top wall of this nut.

When the bolt 64 is loosened, a section 70 of the arm 58 is adapted to be pivoted in a counterclockwise direction. As illustrated, this section defines an end 72 which receives the shaft of bolt 74, the bolt being connected to the arm 58 by means of nut 76. An oil inlet 78 is provided for the shaft bearing of the arm 58.

Figure 3:
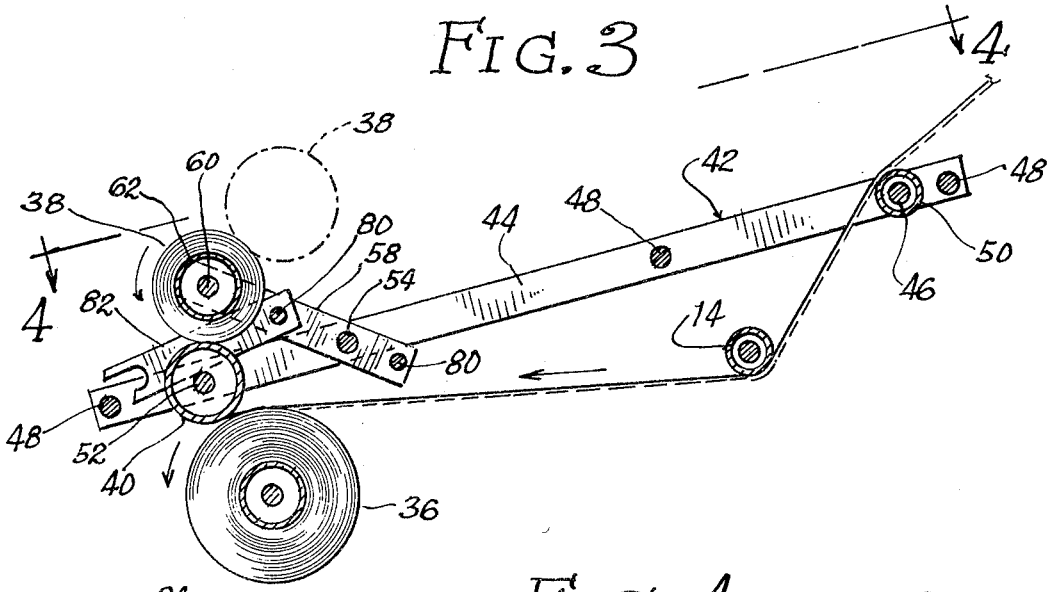
FIG. 3 is a side elevation, partly in section, illustrating a separator structure characterized by the features of the invention.
Figure 4:
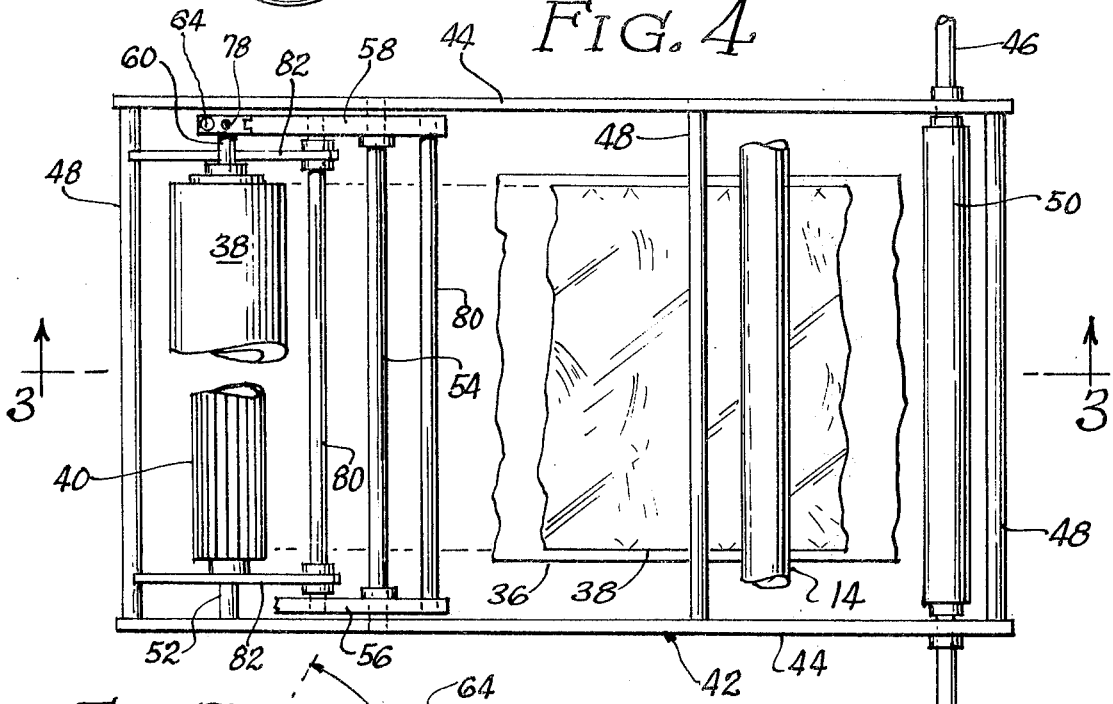
FIG. 4 is a plan view taken about the line 4—4 of FIG. 3.

A pair of tie rods 80 are provided for the arms 56 and 58, and the intermediate tie rod provides a pivotal mount for propping arms 82. As best shown in FIG. 3, the arms 62 define open ends dimensioned to fit onto the shaft 52 for spreader roll 40. It will be apparent that by lifting the take-up roll 62 to the dotted line position shown in FIG. 3, the ends of arms 82 will automatically engage the shaft 52. This serves to prop the arms 56 and 58 in a position out of engagement with spreader roll 40 so that a full take-up roll can be readily removed and an empty roll moved into place. This structure along with the design of arm 58 was selected since this conventional supporting structure greatly facilitates the handling of the stretchable web take-up roll. In this connection, it will be noted that the condition of the stretchable web on the take-up roll is critical and, therefore, smooth operating journalling of the shaft 60 in the arms 56 and 58 is desired. The arm design utilized accomplishes this since one end of the shaft 60 can be quickly separated from the arm 58, and the other end can then be easily pulled out of the arm 56. Thus, speed of operation is not sacrificed while providing smooth operation.

In the operation of the apparatus of the invention, the carrier web serves the important function of maintaining the stretchable web in a substantially stable condition as the stretchable web moves through the apparatus. As indicated, the stretchable web will necessarily encounter a variety of forces during travel through a printing machine including forces generated by idler rollers, edge guides, printing rollers, dryers, and coating rollers. Although a stretchable web such as polyvinyl chloride film could not normally be efficiently printed, the provision of a carrier web in the manner illustrated virtually eliminates the problems normally encountered.

The spreader roll 40 of the invention is provided with a knurled finish, and it has been found that this type of arrrangement will tend to generate lateral forces in the stretchable web engaging the spreader roll. Thus, forces are generated which resist any tendency of portions of the web to move axially of the spreader roll so that the spreader roll assumes the function of the carrier web during travel of the stretchable web after separation from the carrier web and before winding onto the take-up roll. The use of this separator structure thus permits separation as an integral step in the printing operation.

Suitable knurling can be achieved by utilizing a corrugated type roll with the corrugations extending substantially parallel with the roll axis. Utilizing a roll of about 3½ inches in diameter, a 64 pitch, 70°, straight knurl, 0.016 inches deep will provide suitable results. Conventional knurled patterns other than a corrugated type, such as a beaded design, are also contemplated.

In a typical application of the process of the invention, polyvinyl chloride film, "Saran", or other material of the same type, is provided in a roll 10, and a supply of carrier sheet, for example glassine, is provided in a roll 12. As illustrated, the carrier sheet roll may be substantially larger than the product sheet roll so that the frequency of changing the carrier sheet roll is reduced.

In a typical set-up, the polyvinyl chloride web may be between 0.00065 and 0.00125 gauge, and a 35–40 pound glassine web, bleached or unbleached, is used. A polyethylene coating on the glassine provides a more stable carrier web. Saran coated polyethylene is also a contemplated carrier web of highly stable character.

A belt formed entirely of a polyvinyl chloride film or a polyvinyl chloride coated Mylar film is also contemplated for the continuous carrier web. The use of the polyvinyl chloride or other compatible surface is desired so that the film being printed will "seat" efficiently with respect to the carier web. The gauge of the carrier web is primarily governed by strength and durability factors while the gauge of the film, of course, is governed by the production requirement.

The use of a roll of carrier sheet has the advantage that a fresh carrier web can be very readily introduced into the system. Furthermore, a continuous web has a seam where its ends are joined and, therefore, a roll is more suitable for complex printed patterns.

It is contemplated, however, that the carrier sheet comprise a continuous web, that is, a web which extends through the system in the same fashion as the carrier sheet, and which also extends between the stations occupied by the rolls 12 and 36. Such a web is feasible if it is highly durable so that the necessity for replacing the web would be minimized. The continuous web is also desirable since there is better "repeat" performance as compared with the use of a roll of carrier web. The latter is subject to tension forces particularly as the roll diameter decreases.

A particularly satisfactory continuous web comprises a cellophane web coated with Saran (du Pont K 116–207). The ends of the web were spliced in the "working" area of the web with a 0.0018 gauge polyester film tape using a silicone adhesive. A heavier gauge tape was used adjacent the edges since this provided strength without affecting the printing.

The product sheet and carrier sheet are brought into face-to-face relationship and then moved as overlying webs through the illustrated stations. Particularly because of the character of polyvinyl chloride, the product sheet tends to adhere to the carrier sheet thereby providing a stable condition as the polyvinyl chloride is moved through the respective stations. Accordingly, accurate printing, particularly with respect to spacing of repeated patterns, is very efficiently achieved.

At the web separator area of the apparatus, the printed film is removed from the carrier sheet; however, the roller 40 immediately contacts the film thereby substantially eliminating any tendency of the film to stretch beyond desired limits or to vary from a desired path of movement. The roller 40 is particularly valuable from the standpoint of insuring a well-aligned roll of printed product sheet. Thus, this roll 38 is provided in a fashion such that it can be utilized as a supply roll in automatic packaging equipment. Since the supply roll has been wound with the edges thereof in alignment, problems are avoided during movement through the packaging machine.

The design of the separator means adds a great deal of efficiency to the operation. The double pivot structure results in automatic adjustments of the spacing of the respective roll axes so that a roll of product sheet 10 can be completely printed without any need for adjustments in the apparatus. The fact that the printed product sheet is formed in a roll which is immediately usable for automatic packaging equipment is an additional highly valuable feature of the apparatus. As indicated, this is accomplished while still having a mechanism which permits efficient removal of a full roll and replacement of an empty roll. It will also be noted that the combination of the product sheet and carrier web is such that printed surfaces are maintained out of contact with drive rollers or idler rollers from the time printing is commenced until after movement over chill roll 34. Accordingly, the desired stability of the film is accomplished without any sacrifice of printing quality.

It will be understood that various changes and modifications may be made in the above described apparatus which provide the characteristics of this invention without departing from the spirit thereof particularly as defined in the following claims.

That which is claimed:

1. An apparatus for transporting a continuous stretchable web of polyvinyl chloride to be printed comprising a substantially non-stretchable carrier web having a polyvinyl chloride surface for contact with said stretchable web, drive means for moving said carrier web, means for delivering said stretchable web to said carrier web for locating said stretchable web in face-to-face contact with said carrier web whereby said webs are transported in overlying relationship, a web separator for contact with the overlying webs to separate the webs, said separator including spreader means for imparting a laterally directed spreading force to said stretchable web, and means for collecting the separated stretchable web.

2. An apparatus for transporting a continuous stretchable web to be printed comprising a substantially non-stretchable carrier web, drive means for moving said carrier web, means for delivering said stretchable web to said carrier web for locating said stretchable web in face-to-face contact with said carrier web whereby said webs are transported in overlying relationship, a web separator for contact with the overlying webs to separate the webs, said separator including a spreader roll for imparting a laterally directed spreading force to said stretchable web, a take up roll for collecting the separated stretchable web, a first support for said spreader roll, a second support for said stretchable web take up roll, said second support being pivotally mounted on said first support.

3. A construction in accordance with claim 2 including a carrier web take-up roll, said carrier web being wound on said carrier web take-up roll whereby the wound carrier web increases in diameter, said spreader roll being mounted adjacent said carrier web take-up roll, the support for said spreader roll being pivotally mounted whereby the spreader roll moves against said carrier web and the support for the spreader roll pivots as said diameter increases.

4. An apparatus in accordance with claim 3 wherein said stretchable web take-up roll moves with said spreader roll, the stretchable web take-up roll pivoting away from said spreader roll as the diameter of the stretchable web on the stretchable web take-up roll increases.

5. An apparatus in accordance with claim 4 including propping means connected to said mounting means for said stretchable web take-up roll, said propping means operating to hold said stretchable web take-up roll in separated relationship relative to said spreader roll to permit unloading of a full stretchable web take-up roll and attachment of an empty stretchable web take-up roll.

6. An apparatus in accordance with claim 2 wherein said spreader roll comprises a corrugated roll, the corrugations thereof extending substantially parallel with the axis of the spreader roll.

7. In an apparatus for printing a continuous stretchable web of polyvinyl chloride, the improvement comprising a substantially non-stretchable carrier web having a polyvinyl chloride surface for contact with said stretchable web drive means for moving said carrier web, and means for delivering said stretchable web to said carrier web for locating said stretchable web in face-to-face contact with said carrier web whereby said stretchable web substantially adheres to said carrier web and said webs are transported in overlying relationship, guide and drive rolls for the overlying webs, a web separator for separating the webs, and means for collecting the stretchable web.

8. An apparatus in accordance with claim 7 wherein said separator includes a take-up roll for said stretchable web.

9. An apparatus in accordance with claim 8 including spreader means associated with said web separator for imparting a laterally directed spreading force to said stretchable web after separation thereof from said carrier web.

10. An apparatus in accordance with claim 9 wherein said spreader means comprises a spreader roll directing said stretchable web to said take-up roll.

11. An apparatus in accordance with claim 10 including a first support for said spreader roll, a second support for said stretchable web take-up roll, said second support being pivotally mounted on said first support.

12. A construction in accordance with claim 11 including a carrier web take-up roll, said carrier web being wound on said carrier web take-up roll whereby the wound carrier web increases in diameter, said spreader roll being mounted adjacent said carrier web take-up roll, the support for said spreader roll being pivotally mounted whereby the spreader roll moves against said carrier web and the support for the spreader roll pivots as said diameter increases.

13. An apparatus in accordance with claim 12 wherein said stretchable web take-up roll moves with said spreader roll, the stretchable web take-up roll pivoting away from said spreader roll as the diameter of the stretchable web on the stretchable web take-up roll increases.

14. An apparatus in accordance with claim 13 including propping means connected to said mounting means for said stretchable web take-up roll, said propping means operating to hold said stretchable web take-up roll in separated relationship relative to said spreader roll to permit unloading of a full stretchable web take-up roll and attachment of an empty stretchable web take-up roll.

15. An apparatus in accordance with claim 10 wherein said spreader roll comprises a corrugated roll, the corrugations thereof extending substantially parallel with the axis of the spreader roll.

* * * * *